United States Patent [19]

Knodel

[11] 4,179,833

[45] Dec. 25, 1979

[54] INFORMATION REMINDING DEVICE

[76] Inventor: Robert R. Knodel, P.O. Box 40339, Santa Barbara, Calif. 93103

[21] Appl. No.: 939,185

[22] Filed: Sep. 5, 1978

Related U.S. Application Data

[63] Continuation of Ser. No. 769,897, Feb. 18, 1977, abandoned.

[51] Int. Cl.[2] ..... G09F 3/14

[52] U.S. Cl. ..... 40/21 C; 63/1 R; 40/586

[58] Field of Search ..... 402/8; 281/1; 40/21, 40/21 C, 586

[56] References Cited

U.S. PATENT DOCUMENTS

| | | | |
|---|---|---|---|
| 1,166,629 | 1/1916 | Pratt | 40/21 C |
| 1,909,808 | 5/1933 | Buxton | 402/8 |
| 2,139,843 | 12/1938 | Moore | 402/8 |
| 2,553,676 | 5/1951 | Roos | 281/1 |
| 2,561,894 | 7/1951 | Wallich | 40/21 C |
| 3,214,852 | 11/1965 | Ford et al. | 40/586 |
| 4,121,360 | 10/1978 | Vlerebome | 40/21 C |

*Primary Examiner*—Louis G. Mancene
*Assistant Examiner*—Wenceslao J. Contreras
*Attorney, Agent, or Firm*—Eugene M. Eckelman

[57] ABSTRACT

A strap-like body portion is arranged to be mounted on the wrist of a person and has at least one tab with an area on one or both sides which can receive or which contains a reminding message. The tab has a laterally extending opening which receives the body portion and is tiltable in opposite directions for movement between a pair of positions one of which may comprise an indicating position and the other of which may comprise a non-indicating position. The tabs have a slit extending from the bottom edge thereof to the opening for allowing slight distortion for the purpose of attaching the tabs to or detaching them from the body portion.

2 Claims, 3 Drawing Figures

INFORMATION REMINDING DEVICE

This is a continuation, of application Ser. No. 769,897, filed 2-18-77 now abandoned.

BACKGROUND OF THE INVENTION

This invention relates to new and useful improvements in information reminding devices.

Devices have heretofore been provided for reminding persons of certain dates or duties. For example, U.S. Pat. No. 1,407,239 shows a wrist tablet contained in a housing and capable of being supplied with written messages to jog a person's memory. Other similar devices have been provided which allow messages to be written thereon, but all of such devices are of rather complex construction and are not economically feasible to produce. In addition, most of such devices require the use of a pencil, which means that a pencil must be carried on the device or on the person. In addition, such prior devices are limited in the number of messages that can be written thereon since by nature they must be substantially compact.

SUMMARY OF THE INVENTION

According to the present invention and forming a primary objective thereof, an information reminding device is provided which is designed particularly for attachment to a person's wrist and which overcomes deficiencies of prior devices.

In carrying out the invention, the device employs a strap-like body portion having mounting means on its ends arranged to support it on a person's wrist. A plurality of tabs with area portions for receiving messages thereon are arranged for removable attachment to the body portion and are tiltable in opposite directions between indicating and non-indicating positions.

DETAILED DESCRIPTION OF A PREFERRED EMBODIMENT

Figure 1:
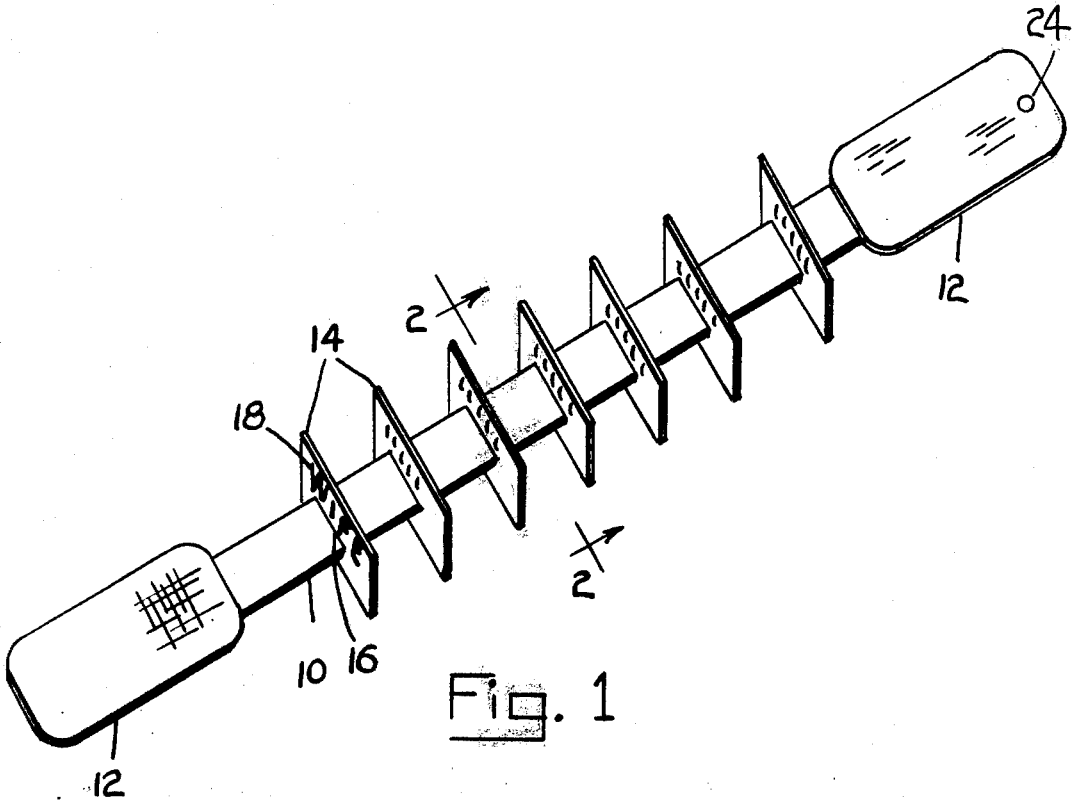
FIG. 1 is a perspective view of the information reminding device embodying features of the present invention.

With particular reference to the drawings, the information reminding device of the present invention comprises a strap-like body portion 10 having end connecting means 12 preferably comprising a releasable connection so that the body portion 10 can readily be attached to and removed from a person's wrist. A good type of connection 12 may comprise a pressure sensitive connection in the form of a separable fastener sold on the market under the trademark Velcro. Such fastener comprises opposed base fabrics utilizing multi-filament loops and fingers capable of forming a locked connection with each other and yet be releasable. Such a connection can be repeatedly attached and detached. It is to be understood, however, that connecting means 12 may comprise a permanent type connection since body portion 10 may comprise a strip of elastic having sufficient flexibility so as to be stretched over the hand for mounting it on the wrist.

Associated with the body portion 10 is one or more tabs 14 having a lateral opening 16 which is arranged for slidable engagement with the body portion 10. One of such tabs is shown in detail in FIG. 2. Openings 16 are spaced down from the top edges of the tabs, and the tabs have a message area 18 above the opening 16. The tabs preferably have a message area on both sides to double the efficiency thereof, and in addition a plurality of such tabs are employed so that many different messages can be set up on the device. The areas 18 may contain a pre-printed message or be furnished in blank form so that the user can print his own message thereon. For this latter purpose, the areas 18 would be provided with a writing surface so as to take pencil, ball point pen, felt pen, etc. It may be desirable as well that the areas 18 be such that the messages can be erased and provided with different messages by the consumer.

Figure 2:
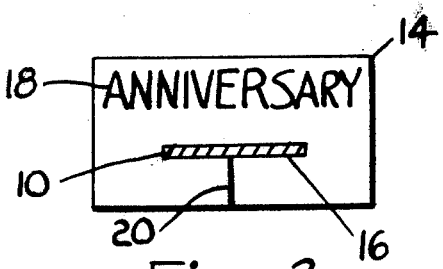
FIG. 2 is a sectional view taken on the line 2—2 of FIG. 1.

Tabs 16 comprise thin strips, such as plastic strips, plated metal strips, or the like, which are light in weight and inexpensive to manufacture. As best seen in FIG. 2, each of the tabs has a slit 20 which extends from the bottom edge to the center of opening 16. By means of this structure, the tabs by a slight distortion at the slitted portion can be attached to and removed from the body portion 10.

Figure 3:
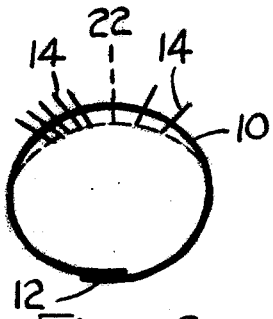
FIG. 3 is a diagrammatic edge view of the device showing it applied to the wrist of a person.

As stated, one use of the invention comprises mounting it on the wrist, and an illustration of such use is shown in FIG. 3, the reference character 22 designating the wrist. It is apparent that when the device is applied to the wrist, the bottom edges of the tabs 14 engage the wrist and cause the tabs to tilt in either one direction or the other. With a medium tight but comfortable connection of the body portion 10 around the wrist, the tabs will remain tilted in one direction or the other unless flipped over. The message portion of the tabs are not visible to the wearer when tipped toward him but on the other hand are visible when tilted away from him. Thus, the wearer can by tilting a tab or multiple tabs away from him make up a desired message. Or, if desired, only selected tabs can be placed on the body portion and the remainder removed. Furthermore, since the tabs are slidable on the body portion, unused tabs may be slid to one end to avoid confusion. Further yet, the tabs may be taken off and reversed so as to bring the opposite side thereof into use.

By means of the present invention, a reminding device is provided which is light in weight, inexpensive to manufacture, and not cumbersome to the person when worn. It may not require the use of a pencil, and by quick attachment or detachment of selected tabs, substantially any desired message can be applied thereto.

Although a preferred purpose of the present device is for attachment to the wrist of a person, it can be supported on a wall surface or the like. For this purpose, one end of the connecting means 12 has an aperture 24 or other suitable means for hanging it on a vertical surface. In this use, the tabs that are to be used are merely flipped down, with the remaining tabs being slid to one end of the body portion in a non-use position.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. An information reminding device comprising (a) an elastic strap-like body portion arranged to be supported on a person's wrist, (b) mounting means on the ends of said body portion arranged to hold said device on the wrist in tensioned relation, (c) a plurality of tabs mounted on said body portion having top and bottom edges, (d) said tabs having a laterally extending opening receiving said body portion, (e) said laterally extending opening being located between said top and bottom edges of said tabs, (f) the tab portion above said openings having a surface area arranged to receive a reminding message thereon, (g) the tab portion below said openings forming a tongue arranged to have bottom edge engagement with the wrist, (h) said tabs being tiltable in one direction or the other by the forceful engagement of their bottom edges against the wrist as a result of the elasticity of said body portion whereby said tabs can be moved manually to one tilted position which may comprise an indicating position or the other tilted position which may comprise a non-indicating position.

2. The information reminding device of claim 1 wherein said tabs have a slit extending between one of said top and bottom edges thereof and said laterally extending openings for receiving said body portion in a function of mounting said tabs on said body portion.

* * * * *